US007984819B1

(12) United States Patent
Davis

(10) Patent No.: US 7,984,819 B1
(45) Date of Patent: Jul. 26, 2011

(54) COLLAPSIBLE SHIPPING CONTAINER

(76) Inventor: Michael B Davis, Palm City, FL (US)

( * ) Notice: Subject to any disclaimer, the term of this patent is extended or adjusted under 35 U.S.C. 154(b) by 1063 days.

(21) Appl. No.: 11/769,059

(22) Filed: Jun. 27, 2007

Related U.S. Application Data

(60) Provisional application No. 60/817,026, filed on Jun. 28, 2006.

(51) Int. Cl.
*B65D 6/00* (2006.01)
*B65D 8/14* (2006.01)
*B65D 69/00* (2006.01)

(52) U.S. Cl. ..... 220/4.28; 220/1.5; 220/6

(58) Field of Classification Search ..... 220/4.28, 220/4.29, 1.5, 6, 666; 206/577, 600; 414/498; 410/52
See application file for complete search history.

(56) References Cited

U.S. PATENT DOCUMENTS 3,765,556 A * 10/1973 Baer ..... 220/1.5
5,064,068 A * 11/1991 Sheng ..... 206/425
5,509,559 A * 4/1996 Okano et al. ..... 220/1.5
7,240,799 B2 * 7/2007 Zhang ..... 206/600
7,882,973 B2 * 2/2011 Krohn ..... 220/1.5

* cited by examiner

*Primary Examiner* — Anthony Stashick
*Assistant Examiner* — Shawn M Braden
(74) *Attorney, Agent, or Firm* — Gold & Rizvi, P.A.; H. John Rizvi; Glenn E. Gold

(57) ABSTRACT

A rectangular collapsible, stackable shipping container is provided that is capable of safely, stably, and securely carrying cargo and is capable of being reliably collapsed to save space when empty. The collapsible shipping container preferably includes a top section assembly, bottom section assembly, opposing end wall assemblies, and opposing horizontally hinged side wall panels that are interconnected and articulated. The opposing side wall panels are formed of at least two articulating longitudinal sections and also articulate with the bottom frame section, folding inwardly and downwardly when collapsed. The opposing end wall assemblies, one of which is configured as a door, articulate with the top roof section and with the bottom frame section, folding inwardly when collapsed. Provision is made for increasing security via the integration of a security device in the container walls. Additionally provision is made for weight-reduction through the utilization of a non-metallic material.

17 Claims, 16 Drawing Sheets

-12-

-11-

-19-

COLLAPSIBLE SHIPPING CONTAINER

CROSS-REFERENCE TO RELATED APPLICATION

This application claims the benefit of U.S. Provisional Patent Application Ser. No. 60/817,026, Jun. 28, 2006, which is incorporated herein in its entirety.

BACKGROUND OF THE INVENTION

1. Field of the Invention

The present invention relates generally to reusable, freight containers for the transportation of cargo, and more particularly to a collapsible cargo shipping container capable of carrying large quantities of goods when in use and capable of being folded for compact storage when not in use.

2. Description of the Prior Art

Standard shipping containers are designed and constructed for transportation of general cargo on sea, rail, and roadways. The ISO standard shipping containers used around the world are basically steel boxes, either 20 foot or 40 foot long, 8 foot 6 inches wide, and 8 foot tall, with high-cube containers for voluminous and lightweight cargo being 9 foot 6 inches high.

A substantial percentage of the cost for shipping and storage of goods is in transportation and storage of empty containers. The volume of international trade continues to increase with approximately 90% of non-bulk cargo worldwide moved via over 18 million shipping containers stacked on transport ships. However, the volume of goods shipped between countries is not equal. Therefore, many shipping containers must be shipped around the world empty. For example, the Port of Los Angeles reports for the year 2005 that 67% of the containers that left the Port of Los Angeles were empty.

Additionally, a large number of empty containers must be stored at the dock loading areas, railroad yards, and container yards, where space is at a premium. A shipping container that could be utilized with existing roadway, sea, and rail equipment but required less space for shipping and storing would be economically advantageous. Additionally, a collapsible shipping container that was both lightweight and collapsible would save not only on storage volume, but also on fuel costs for transporting full or empty shipping containers.

Another challenge to the shipping industry, which has increasingly become a concern due to potential terrorist attacks, is security. The massive number of shipping containers moving from country to country combined with the difficulty in tracking shippers, shipments, and container movement multiplies the danger. Improved security would be advantageous not only to the shippers and receivers of goods, but also to governments in protecting their citizens.

Accordingly, there is an established need for a collapsible shipping container meeting the current ISO standards, that is capable of safely and securely carrying cargo when expanded and capable of being collapsed to save space when empty, and that optionally offers the potential to increase security and reduce weight.

SUMMARY OF THE INVENTION

The present invention is directed to a sturdy rectangular, collapsible, stackable shipping container that is capable of safely and securely carrying cargo and is capable of being collapsed to save space when empty. The collapsible shipping container preferably includes a top section assembly, a bottom section assembly, opposing end wall assemblies, and opposing horizontally hinged side wall panels; these elements are interconnected and articulated to provide for stability when the collapsible shipping container is expanded, yet provide a reliable and convenient method of collapsing the container. Optionally, but preferably the collapsible shipping container includes a security device.

The opposing side wall panels comprise at least two articulating longitudinal sections, and they articulate with the bottom frame section, folding inwardly and downwardly when collapsed. The opposing end wall assemblies, one of which is configured as a door, articulate with the top roof section and with the bottom frame section, folding inwardly when collapsed. Increased security is provided via the integration of a security device or scanning devices in the container walls. Additionally provision is made for weight-reduction through the utilization of a non-metallic material.

An object of the present invention is to provide a collapsible shipping container that is configured to meet current industry standards for shipping containers.

A further object of the present invention is to provide a collapsible shipping container that provides secure, stable, and sturdy containment of the shipped cargo.

Another object of the present invention is to provide a collapsible shipping container that is configured to collapse when not in use to save space.

An additional object of the present invention is to provide a collapsible shipping container that is configured to optionally allow for the insertion of a security device or scanning devices.

Another object of the present invention is to provide a collapsible shipping container that can optionally be manufactured with non-metallic materials for weight reduction.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, wherein like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward a sturdy, space-saving, collapsible shipping container capable of securely holding large quantities of cargo when in use and capable of folding to save significant space when not in use.

Figure 1:
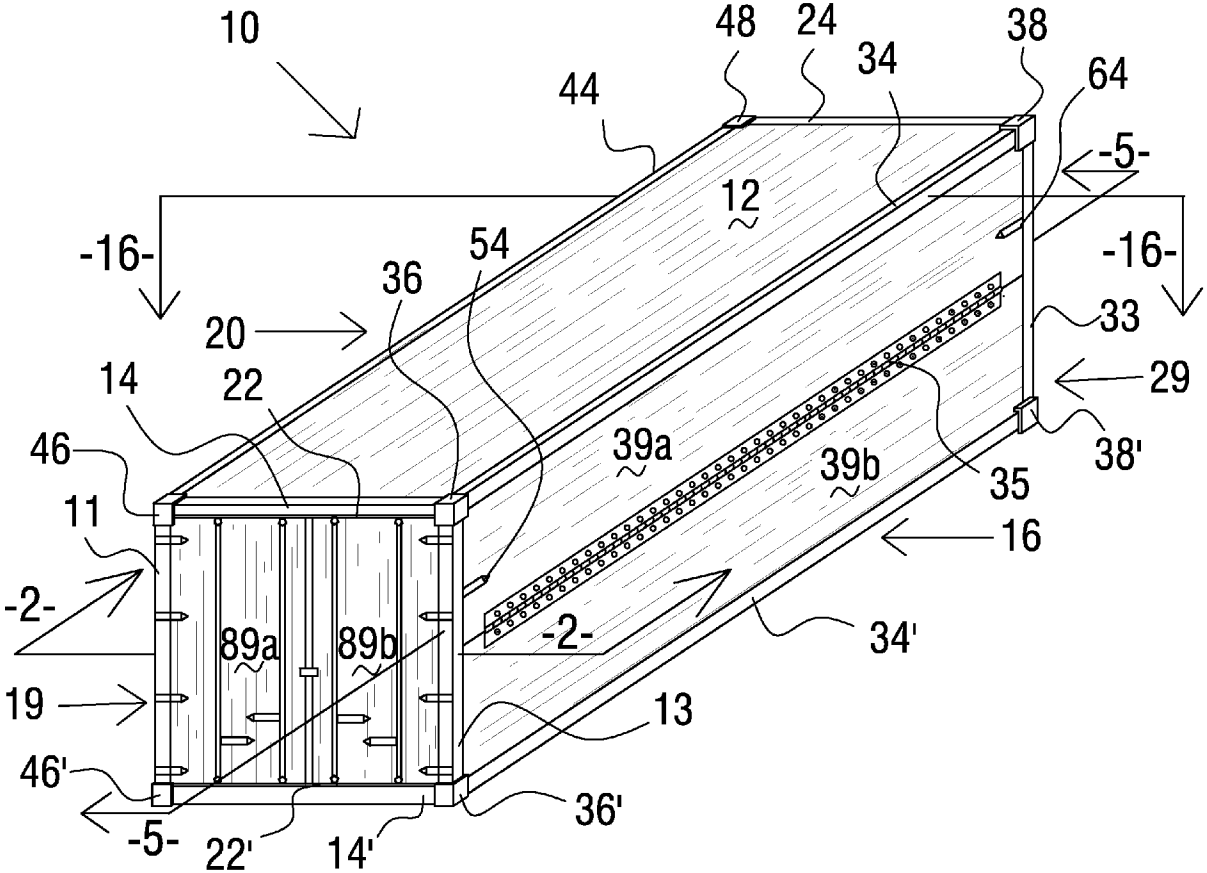
FIG. 1 is a perspective view showing a preferred embodiment of the collapsible shipping container of the present invention.

Referring now to FIG. 1, a collapsible shipping container, shown generally as reference number 10, is illustrated in accordance with a preferred embodiment of the present invention. As shown, the collapsible shipping container is a right-angle parallelepiped, which is the standard shape for shipping containers (also referred to as ISO containers or inter-modal containers). The collapsible shipping container is preferably dimensioned and configured for use with a wide variety of existing cargo handling, moving, storing, and transporting equipment, for example, trucks, trains, tractors, forklifts, cranes, container ship cell guides, dock equipment, yard equipment, and the like.

Figure 10:
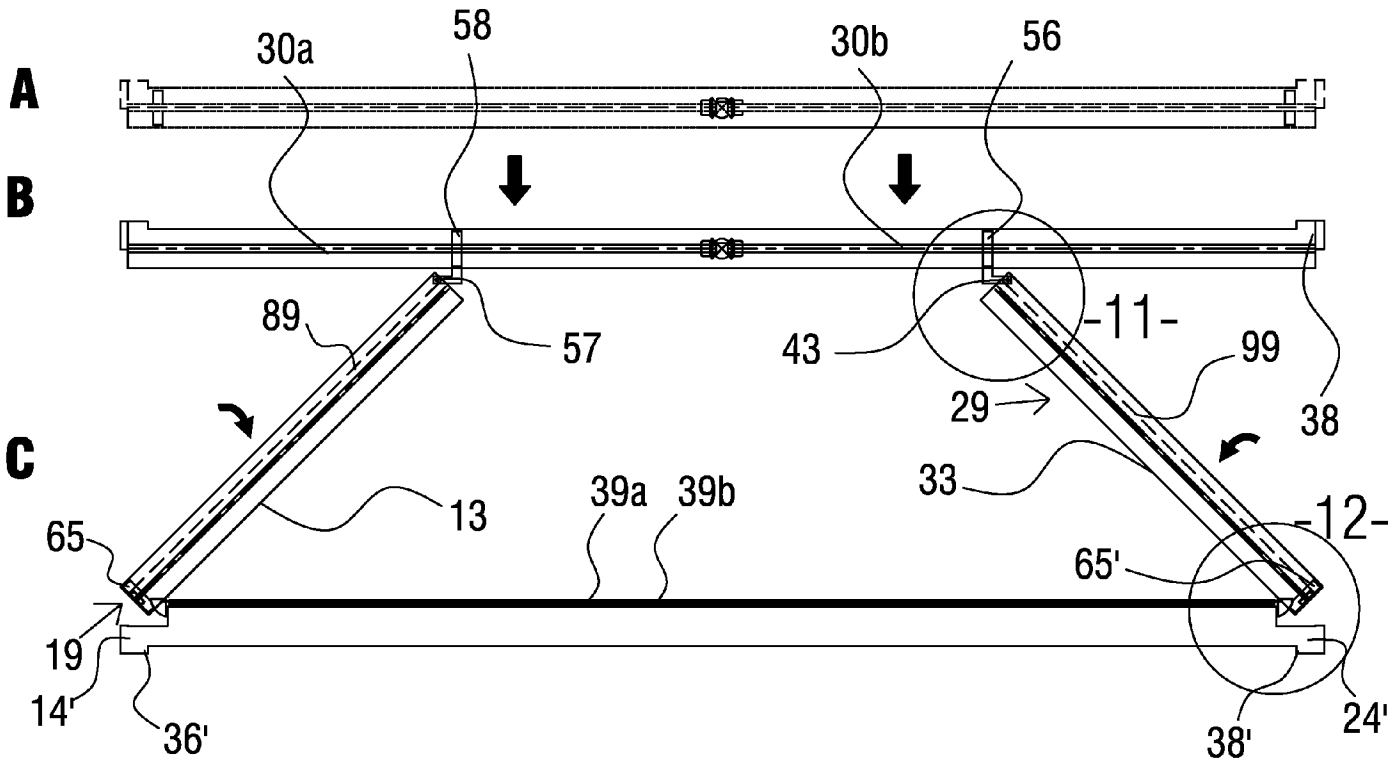
FIG. 10 is a cut-away side view along the lines 5-5 of FIG. 1 illustrating the collapsing operation of the end wall assemblies of the first preferred embodiment of the collapsible shipping container of the present invention.

The collapsible shipping container 10 includes the following main outer sections (with their associated parts) connected together by articulating junctures and interlocking members: a top section assembly 20, a bottom section assembly 16, two hinged opposing side wall panels 39 and 49 (FIG. 8), and two opposing end wall assemblies 19 (FIG. 1, 10) and 29 (FIG. 10).

In overview, the collapsing of the collapsible shipping container 10 is accomplished by first folding the two hinged opposing side wall panels 39 and 49 in upon themselves and then lowering the end wall assemblies 19 and 29 simultaneously as the top section assembly 20 is lowered toward the bottom section assembly 16.

Figure 16:
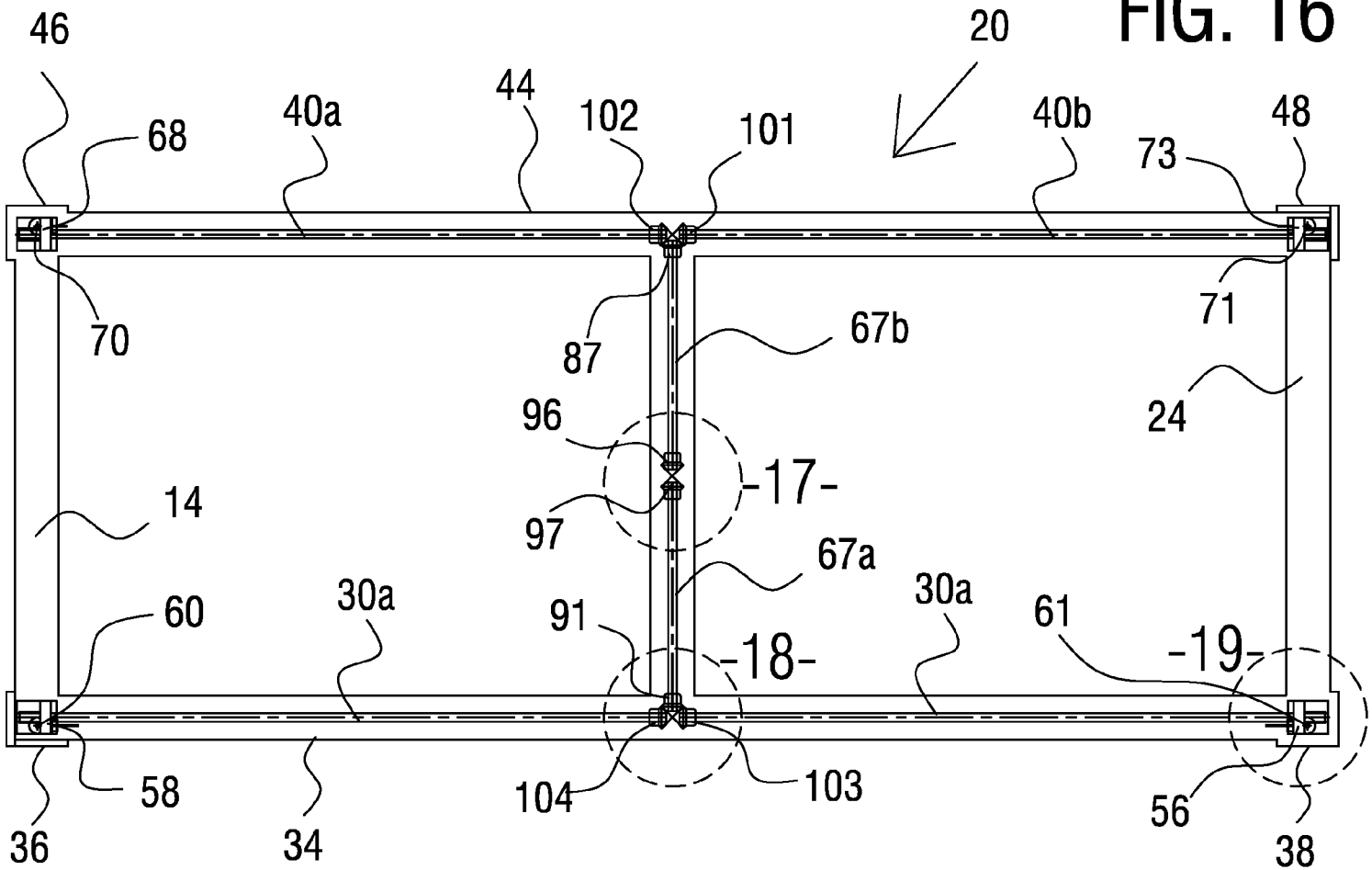
FIG. 16 is a cut-away top view along the lines 16-16 of FIG. 1, extending midway through upper longitudinal edge beams 34 and 44, just below roof panel 12, illustrating the erect state of the first preferred embodiment of the collapsible shipping container of the present invention.
Figure 17:
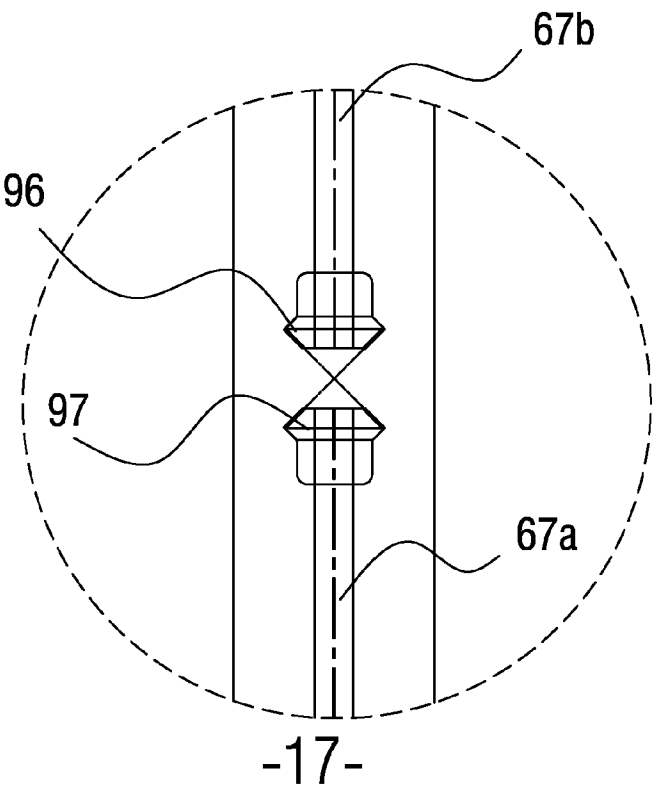
FIG. 17 is a detail of circle -17- of the cut-away top view of FIG. 16 focusing on a portion of the center area of the top section assembly of the first preferred embodiment of the collapsible shipping container of the present invention.
Figure 18:
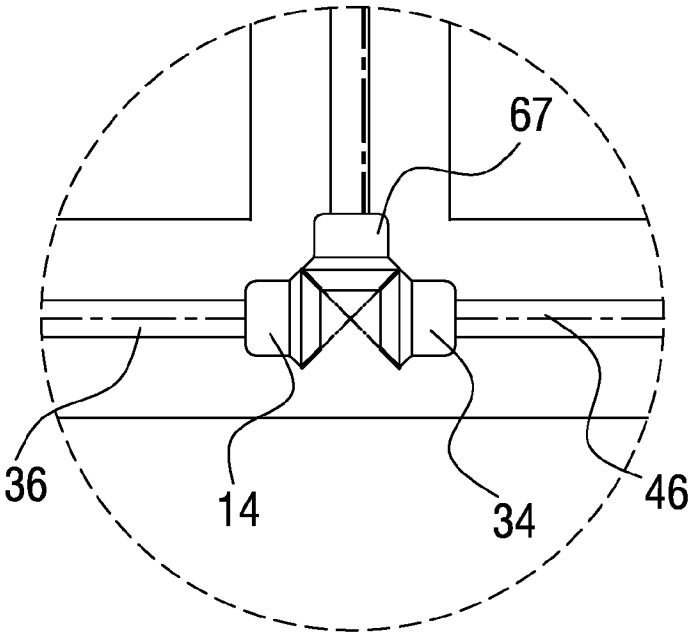
FIG. 18 is a detail of circle -18- of the cut-away top view of FIG. 16 focusing on a portion of the top section assembly of the first preferred embodiment of the collapsible shipping container of the present invention.
Figure 19:
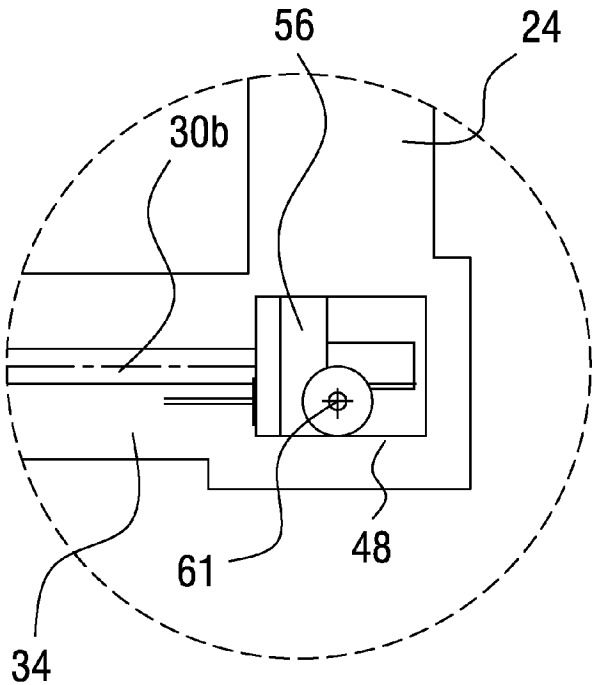
FIG. 19 is a detail of circle -19- of the cut-away top view of FIG. 16 focusing on a portion of a corner section of the top section assembly of the first preferred embodiment of the collapsible shipping container of the present invention.

The top section assembly 20 generally comprises the following connected parts: roof panel 12, forward corner fittings 36 and 46, rear corner fittings 38 and 48, horizontal male threaded rods 30*a*, 30*b* (FIG. 2, 16) and 40*a*, 40*b* (FIG. 2, 16), upper latitudinal center shaft 67 *a*, 67 *b* (FIG. 16, 17), upper longitudinal (side) edge beams 34 and 44 (FIG. 1, 16), and upper latitudinal (end) edge beams 14 and 24 (FIG. 1, 16).

The bottom section assembly 16 generally comprises the following connected parts: lower longitudinal edge beams 34' (FIG. 1) and 44' (not shown), lower forward corner fittings 36' and 46', lower rear corner fittings 38' (FIG. 1) and 48' (not shown), lower latitudinal (end) edge beams 14', 24' (FIG. 10), and floor panel 21.

Front end wall assembly 19 generally comprises the following connected parts: front end wall panel 89, front corner jamb 13, front corner jamb 11, and preferably a strengthening top member 22 and bottom member 22' running parallel to the upper and lower edges of front end wall panel 89.

Rear end wall assembly 29 generally comprises the following connected parts: rear end wall panel 99, rear corner jamb 33 and the opposite rear corner jamb (not shown), and preferably a strengthening top member and bottom member running parallel to the upper and lower edges of rear end wall panel 99.

The main outer sections are constructed of any material with sufficient strength to support and contain the cargo, such as high strength composite material, steel, aluminum, polymers, or wood. However, to construct the collapsible shipping container 10 as a lightweight container, preferably high strength composite material is used. The end wall panels 89, 99 and side wall panels 39 and 49 are preferably of a flat reinforced material, either of a solid material or of layered composition, and may optionally be corrugated, and may be supported by additional framing and bracing as required for panel support or by the specifications for particular uses, as is known in the art. The corner fittings 36, 38, 46, 48, 36', 38', 46', 48' are preferably the conventional ISO-type corner fittings meeting ISO 1161 and adapted for lifting and for tie down.

Referring to the top section assembly 20 (FIG. 1 and FIG. 16), upper longitudinal edge beams 34 and extend along the longer longitudinal edges of substantially flat roof panel 12, while edge beams 14 and 24 extend along the shorter latitudinal edges of roof panel 12. Upper longitudinal edge beams 34, 44 and upper latitudinal edge beams 14, 24 are firmly attached at their ends to upper forward corner fittings 36, 46 and upper rear corner fittings 38, 48, together providing a framework and support for roof panel 12.

Figure 2:
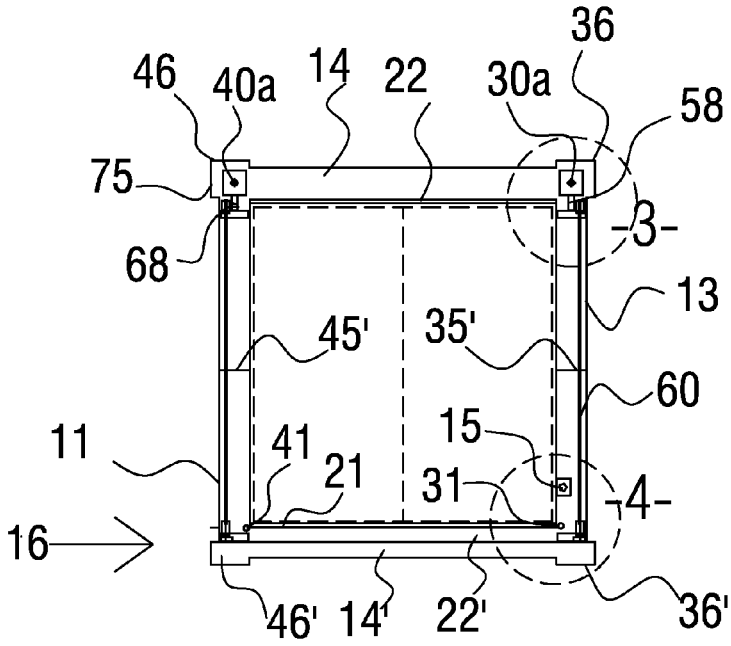
FIG. 2 is a cut-away end view along the lines 2-2, extending midway through front corner jambs 11 and 13 just behind end wall panels 89*a* and 89*b*, of FIG. 1 showing the first preferred embodiment of the collapsible shipping container of the present invention.
Figure 3:
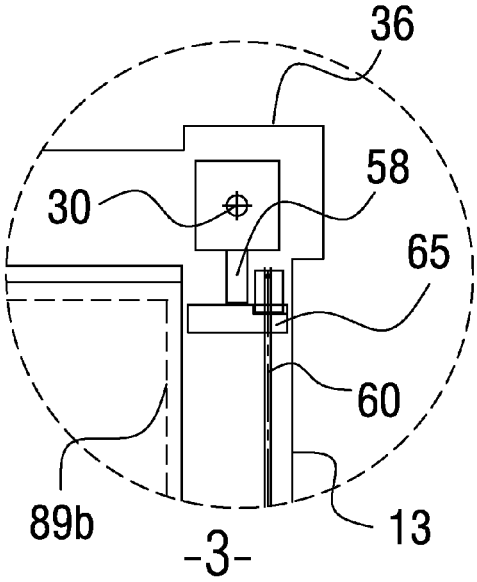
FIG. 3 is a detail of circle -3- of the cut-away end view of FIG. 2, focusing on an upper portion of the side wall panel and top section assembly of the first preferred embodiment of the collapsible shipping container of the present invention.

The upper latitudinal edge beams 14, 24 are not connected along their lower length to the upper edges of end wall assemblies 19, 29, but instead end wall assemblies 19, 29 articulate with top section assembly 20 through the action of horizontal linear actuators providing longitudinal linear movement, shown as male threaded rods 30*a*, 30*b*, 40*a*, 40*b* (FIG. 2, 10). Upper latitudinal edge beams 14, 24 are preferably configured with a vertical downward projecting edge or lip which provides a close fit with end wall assemblies 19 and 29 when the collapsible shipping container 10 is in the expanded state, thereby providing a weather-resistant closure.

The upper edges of side wall panels 39, 49 meet, but are not attached to, the lower edges of upper longitudinal edge beams 34, 44 of top section assembly 20. Preferably, upper longitudinal edge beams 34, 44 are configured with a vertical downwardly projecting channel into which the upper edge of side wall panels 39 and 49 slide when the collapsible shipping container 10 is expanded. The channel provides a close fit with side wall panels 39 and 49, thereby providing a weather-resistant closure. The channel also provides support to the top edges of side wall panels 39, 49 and assists in stabilizing the vertical, expanded state of side wall panels 39, 49.

Upper longitudinal edge beams 34 and 44 support threaded, cylindrical, horizontal male threaded rods 30*a*, 30*b* and 40*a*, 40*b*, respectively. The horizontal male threaded rods 30*a*, 30*b*, 40*a*, 40*b* extend substantially the length of upper longitudinal edge beams 34 and 44. Horizontal male threaded rods 30*a* and 40*a* assist in the collapsing of end wall assembly 19. Horizontal male threaded rods 30*b* and 40*b* assist in the collapsing of end wall panel 29. Optionally, guide tracks can be included to assist in stabilizing male threaded rods 30*a*, 30*b*, 40*a*, 40*b*.

Horizontal male threaded rod 30*a* engages a front horizontally-traveling female-threaded nut 58 and horizontal male threaded rod 30*b* engages a rear female-threaded nut 56 (FIG. 10, 16). Threaded nuts 56, 58 are configured to move along the horizontal axis of male threaded rods 30*a*, 30*b* and are preferably formed of a block of metal perforated with a threaded hole, having threads complementary to the threads of the male threaded rods 30*a*, 30*b*.

Figure 11:
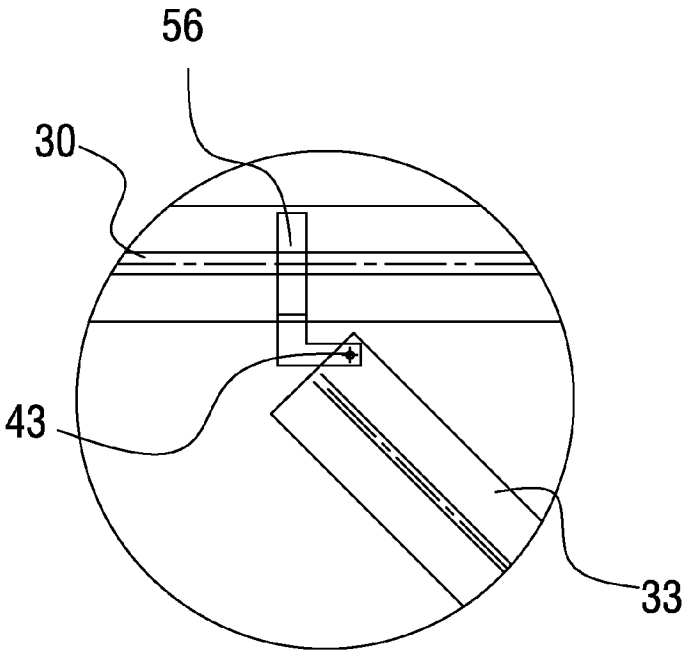
FIG. 11 is a detail of circle -11- of the cut-away side view of FIG. 10 focusing on a portion of the end wall during the collapsing operation of the end wall assemblies of the first preferred embodiment of the collapsible shipping container of the present invention.

Threaded nut 58 is connected to the front corner jamb 13 by means of a right front corner jamb-nut hinge 57 (FIG. 10). Threaded nut 56 is connected to a rear corner jamb 33 by means of a right rear corner jamb-nut hinge 43. (FIG. 11) In a similar manner, horizontal male threaded rods 40*a*, 40*b* engage female-threaded nuts 68, 73 that are hingedly connected to front left corner jamb 11 and rear left corner jamb (not shown).

The two upper latitudinal center shafts 67 *a*, 67 *b* (FIG. 16, 17) extend from an upper central area of the collapsible shipping container 10 toward the upper longitudinal edge beams 34 and 44. External power is supplied to the two miter gears 96, 97 located at the central ends of shaft 67*a*, 67*b*. A miter gear from the external power supply (not shown) meshes with and drives miter gears 96, 97. The shafts 67*a*, 67*b* carry the power along to miter gears 87, 91 disposed on the opposite ends of each shaft. Miter gear 87 meshes with miter gears 101, 102 located on the central ends of horizontal male threaded rods 40*a*, 40*b*. Similarly, miter gear 91 meshes with miter gears 103, 104 located on the central ends of horizontal male threaded rods 30*a*, 30*b*.

Thus through the action of these miter gears and shafts, the rotational movement of the external power is distributed equally to the four horizontal threaded rods 30*a*, 30*b*, 40*a*, and 40*b*. Horizontally-traveling female threaded nuts 56, 58, 68, 73 move along the horizontal male threaded rods 30*a*, 30*b*, 40*a*, and 40*b* providing longitudinal linear motion to collapse or to erect the end wall assemblies 19 and 29.

For convenience of manufacturing ease, the horizontal threaded rods 30, 40 are shown as separated into two separate rods 30*a*, 30*b*, 40*a*, 40*b*, respectively, although this is not necessary for the practice of the invention. Functionally, a single right horizontal rod 30 with opposite handed threads on the two ends and a single left horizontal rod 40 with opposite handed threads on the two ends are equivalent and within the scope of the invention.

Figure 4:
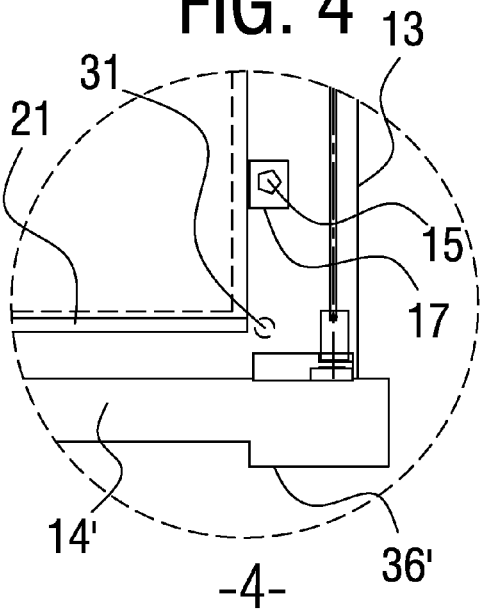
FIG. 4 is a detail of circle -4- of the cut-away end view of FIG. 2, focusing on a lower portion of the side wall panel and bottom section assembly of the first preferred embodiment of the collapsible shipping container of the present invention.

As seen in FIG. 2 and FIG. 4, the collapsible shipping container 10 has a flat horizontal base or bottom section assembly 16. Bottom section assembly 16 is made substantially stronger than top section assembly 20, as is required to support the load of the cargo. The upper surface of bottom section assembly 16 is floor panel 21, which lines the inside bottom of the collapsible shipping container 10. Floor panel 21 may be made of composite material, wood, or other suitable material, with suitable bracing and reinforcing members.

Lower longitudinal edge beams 34' and 44' (not seen, but at the lower edge of side panel 49, below and opposing 44) extend along the longitudinal edges of bottom section assembly 16. Lower latitudinal edge beam 14' and 24' extend along the latitudinal edges of bottom section assembly 16. Lower longitudinal edge beams 34', 44' and lower latitudinal edge beams 14', 24', lower forward corner fittings 36' and 46', lower rear corner fittings 38' and 48' together provide a lower framework and support for floor panel 21.

Figure 5:
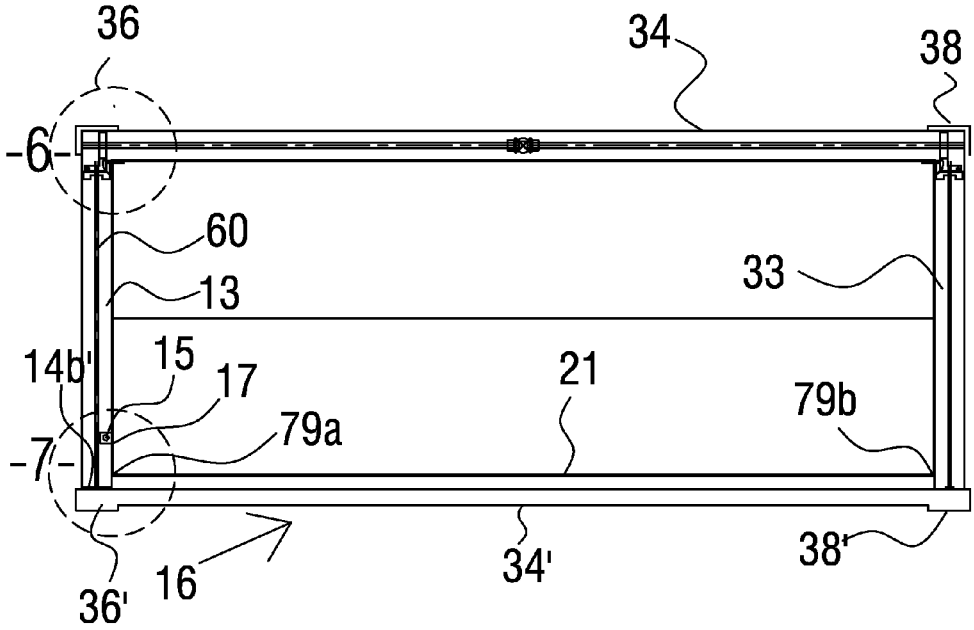
FIG. 5 is a cut-away side view along the lines 5-5, extending midway through front corner jamb 11 and rear corner jamb 33, of FIG. 1 of the first preferred embodiment of the collapsible shipping container of the present invention.

The two opposing end wall assemblies 19 and 29 of collapsible shipping container 10 are vertical when the collapsible shipping container 10 is in the expanded state, but articulate to a horizontal position when the collapsible shipping container 10 is collapsed (FIG. 5). Front corner jambs 11 and 13 are columns that extend along the vertical edges of front end wall panel 89 providing support for end wall panel 89. Similarly, right rear corner jamb 33 and left rear corner jamb (not shown) are columns that extend along, and provide support to, the vertical edges of rear end wall panel 99.

Figure 7:
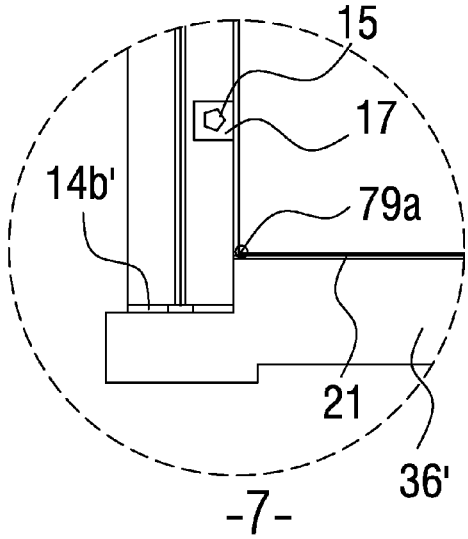
FIG. 7 is a detail of circle -7- of the cut-away side view of FIG. 5, focusing on a lower portion of the front end wall and bottom section assembly of the first preferred embodiment of the collapsible shipping container of the present invention.

Front corner jambs 11 and 13 are hingedly connected at their lower ends to bottom section assembly 16 by front-bottom hinges. In a similar manner, opposing right rear corner jamb 33 and left rear corner jamb (not shown) are hingedly connected to bottom section assembly 16 by rear-bottom hinges. The front-bottom hinges and rear-bottom hinges are configured to provide proper positioning of the bottom of collapsed end wall assemblies 19, 29 above the collapsed side wall panels 39, 49 below it. The hinges may be either external or internal hinges and are illustrated as internal first front-bottom hinge 79*a* (FIG. 7) with a second front-bottom hinge 69*a* (FIG. 12) and first rear-bottom hinge 79*b* (FIG. 5) with a second rear-bottom hinge. Alternatively, for ease of loading the forward hinges front-bottom hinges and rear-bottom hinges may be external.

End wall panel 89 comprises two sections, end wall panel 89*a* and end wall panel 89*b*, that allow access to the interior of the collapsible shipping container 10. The standard associated hardware is preferably included to allow for opening, closing, and sealing of end wall panels 89*a* and 89*b*, including door hinges 18 disposed on the outer edges of end wall panels 89*a* and 89*b*.

Front corner jambs 11 and 13 also provide a housing for the front threaded cylindrical vertical linear actuators shown as vertical male threaded rods 60 and 70, which generally extend the height of front corner jambs 13 and 11, respectively. In a similar manner, rear vertical male threaded rods 61, 71 (vertical ends of which may be seen in FIG. 16) are housed in rear right corner jamb 33 and rear left corner jamb (not shown).

Figure 6:
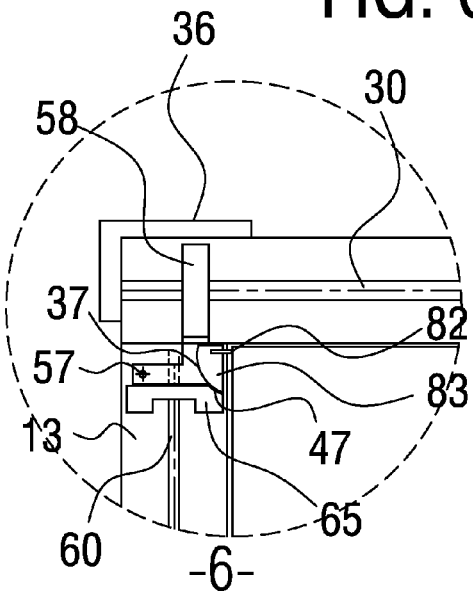
FIG. 6 is a detail of circle -6- of the cut-away side view of FIG. 5, focusing on an upper portion of the front end wall and top section assembly of the first preferred embodiment of the collapsible shipping container of the present invention.

Four female-threaded vertically-traveling nuts, 65 (FIG. 6), 65', 75, 75', are engaged on, and move on the vertical axis of, the two front vertical male threaded rods 60, 70 and the two rear vertical male threaded rods 61, 71. The vertically-traveling nuts 65, 65', 75, 75' are formed of a block of metal perforated with a threaded hole, having threads complementary to the threads of threaded rods 60, 61, 70, and 71. The vertically-traveling nuts 65, 65', 75, 75' are configured with a concave receiving edge 47, which is a concave rounded surface on the inward-facing edge of each of the vertically-traveling nuts 65, 65', 75, 75'. Concave receiving edge 47 receives a complementarily shaped block of the block and pin assemblies of the side wall panels.

Front vertical male threaded rods 60, 70 and rear vertical male threaded rods 61, 71, along with their associated vertically-traveling nuts 65, 65', 75, 75', are utilized in the collapsing of the side wall panels 39*a*, 39*b*, 49*a*, and 49*b*.

The collapsible shipping container 10 has two opposing side wall panels, right side wall panel 39 and left side wall panel 49, that are vertical when the collapsible shipping container 10 is in the expanded state. Side wall panels 39 and 49 are hinged along their lower edges. Side wall panel 39 articulates with bottom section assembly 16 by means of two hinges, forward side wall panel hinge 31 (FIG. 2) near corner fitting 36' and a rearward side wall panel hinge near corner 38' (not shown). The opposing side wall panel 49 articulates in a similar manner.

Figure 8:
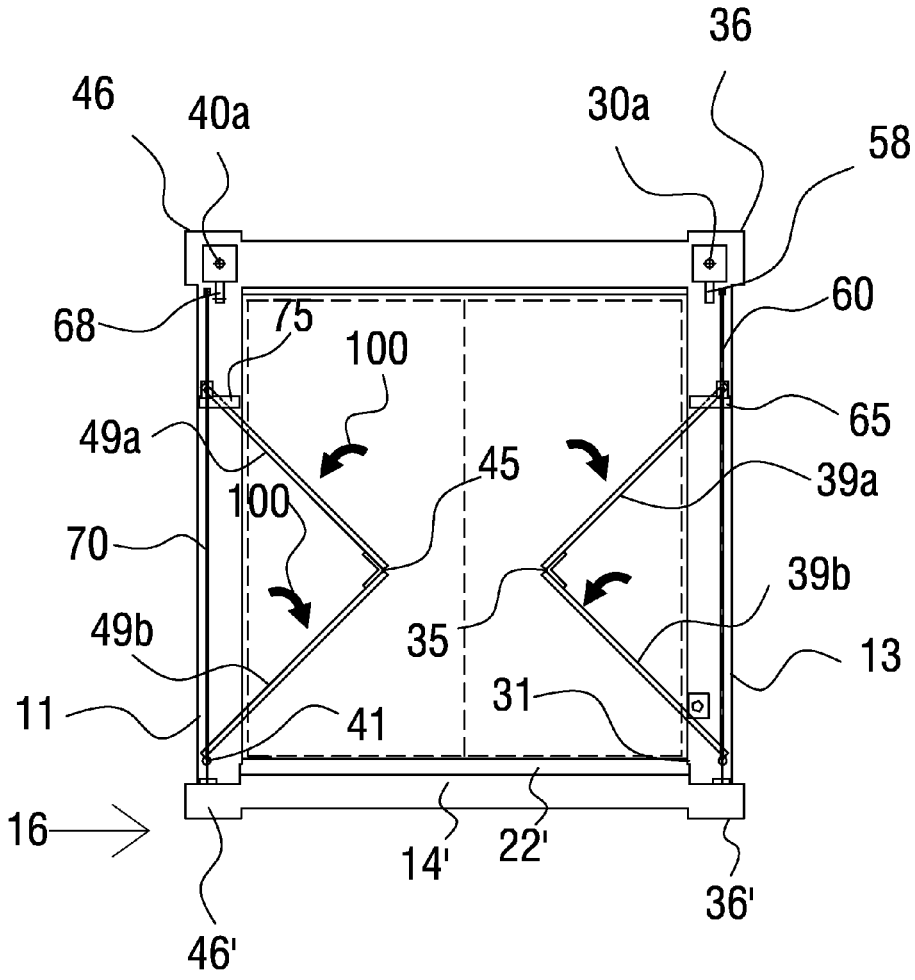
FIG. 8 is a cut-away end view along the lines 2-2 of FIG. 1 illustrating the collapsing operation of the side panels of the first preferred embodiment of the collapsible shipping container of the present invention.
Figure 9:
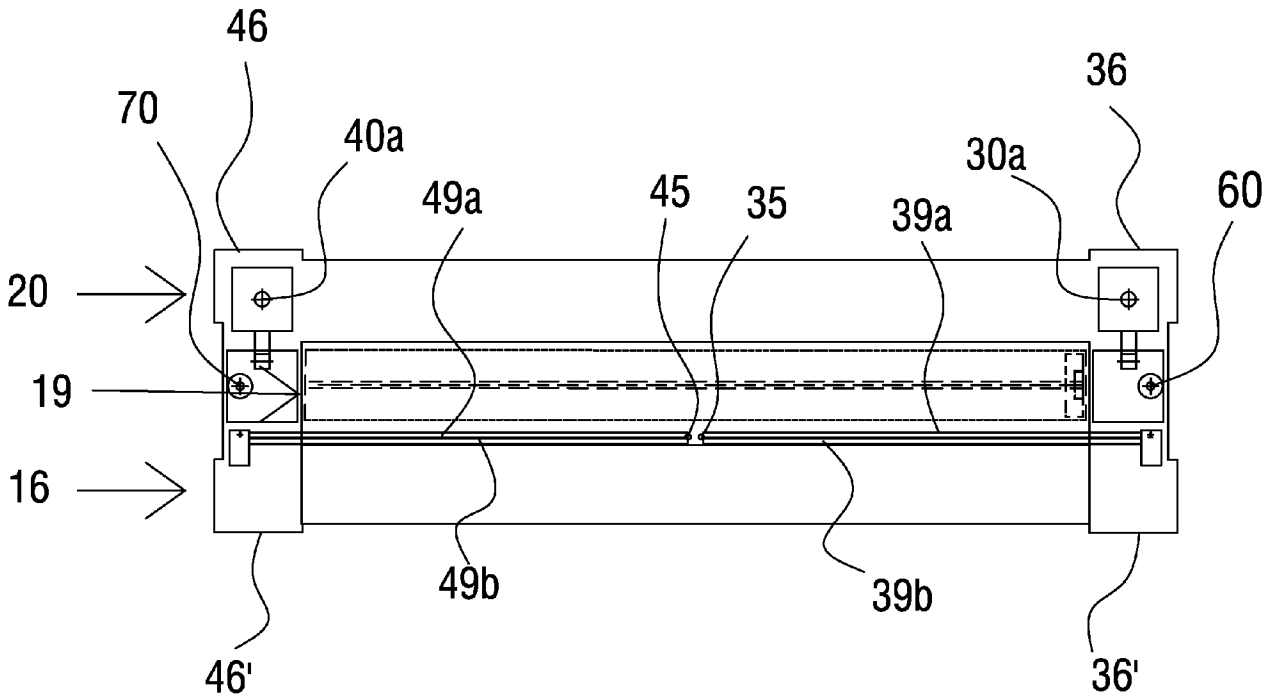
FIG. 9 is a cut-away end view along the lines 2-2 of FIG. 1 illustrating the collapsed state of the first preferred embodiment of the collapsible shipping container of the present invention.

As illustrated in FIG. 1 and in FIG. 8, side wall panels 39 and 49 are additionally hinged along a longitudinal central fold line 35' and 45' (FIG. 2) via horizontally extending side wall hinges 35 and 45. The upper side wall panels are designated 39*a* and 49*a* and the lower side wall panels are designated 39*b* and 49*b*, respectively. When shipping container 10 is in the collapsed state, as demonstrated in FIG. 9, side wall panels 39*a* and 39*b* are folded inwardly at side wall hinge 35 and lie doubled over one another just above floor panel 21. Similarly, when collapsible shipping container 10 is in the collapsed state, side wall panels 49*a* and 49*b* are folded inwardly at side wall hinge 45 and lie doubled over one another just above floor panel 21.

The top edges of side wall panels 39*a*, 49*a* are stabilized by hinge pins and block assemblies, which interact with the vertical male threaded rods 60, 61, 70, (located in the four corner jambs) via their associated vertically-traveling nuts 65.

Figure 12:
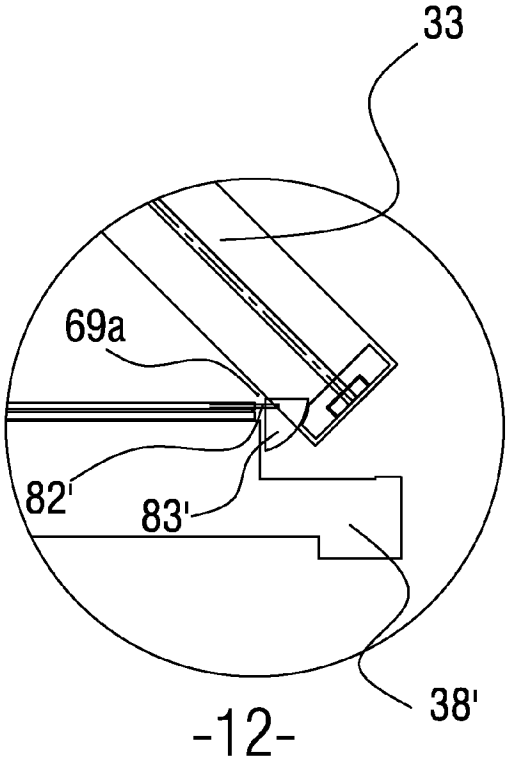
FIG. 12 is a detail of circle -11- of the cut-away side view of FIG. 10 focusing on a portion of the end wall and bottom section, during the collapsing operation of the end wall assemblies of the first preferred embodiment of the collapsible shipping container of the present invention.
Figure 13:
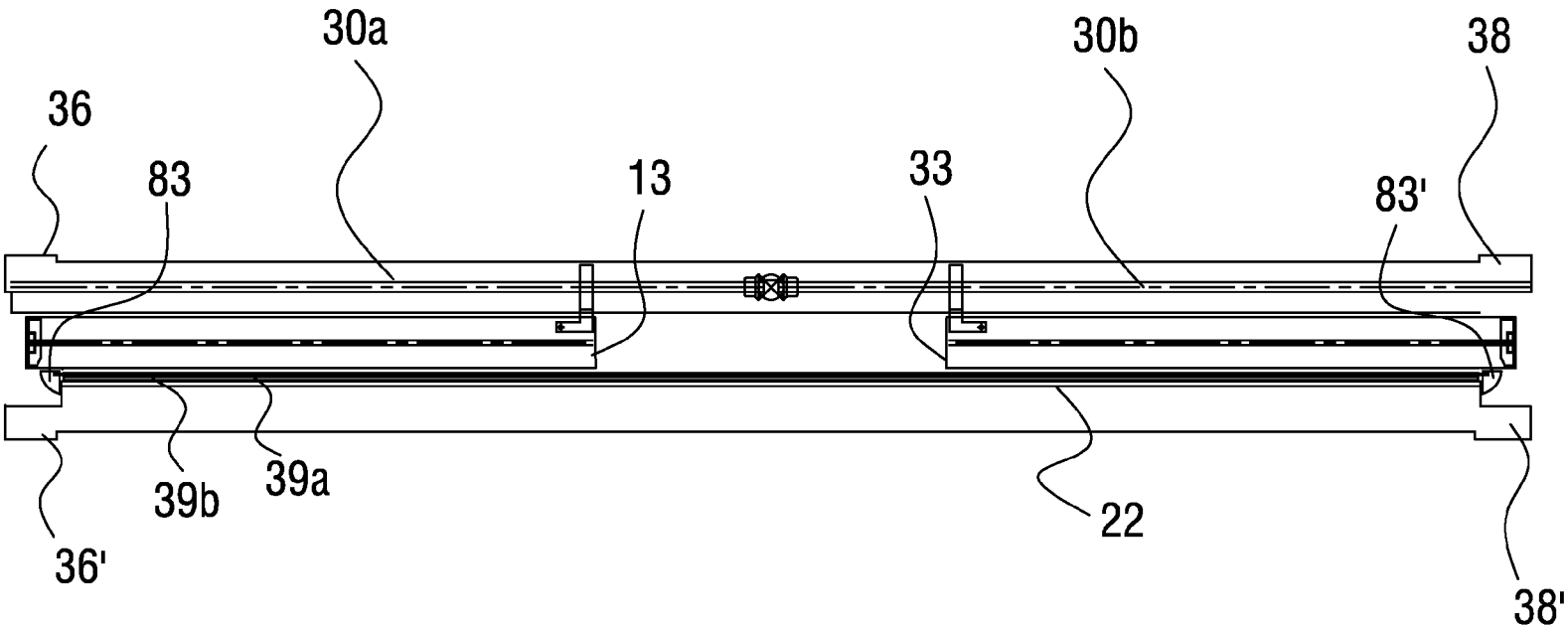
FIG. 13 is a cut-away side view along the lines 5-5 of FIG. 1 illustrating the collapsed state of the end wall assemblies of the first preferred embodiment of the collapsible shipping container of the present invention.

Disposed near the upper edge of side wall panel 39*a* is first hinge pin 82 (FIG. 12). Pin 82 attaches side wall panel 39*a* to first block 83, which is preferably several inches in length, in depth, and in height, as illustrated. Block 83 has one rounded surface 37, which fits against the corresponding rounded surface, receiving edge 47, of vertically-traveling threaded nut 65 disposed on vertical male threaded rod 60. Similarly, the opposite end of side wall panel 39*a* also is fitted with a similar vertically-traveling threaded nut 65', second hinge pin 82', and second block 83' (FIG. 13). Likewise both upper ends of side wall panel 49*a* are fitted with a set of hinge pin and block assemblies, third hinge pin, fourth hinge pin, third block, and fourth block (not shown).

Additional supporting channels to support the vertical threaded nuts and blocks while they are being raised and lowered may be optionally included.

Optionally, at least one forward side latch 54 and one rear side latch 64 may be disposed on side wall panel 39*a* to stabilize the unsecured center section of side wall panel 39*a* when the collapsible shipping container 10 is in the expanded state. (FIG. 1) Additionally, the top edge can be further secured by one or more additional side latches to connect side wall panel 39*a* to top section assembly 20. Side wall panel 49*a* can be similarly provided with latches for stabilization.

FIG. 8 through FIG. 13 illustrate the collapsing operation of shipping container 10. Starting with the expanded shipping container 10 as shown in the various views of FIG. 1, FIG. 2 and FIG. 5, side latches 54 and 64 are unlatched.

External power (not shown) is applied to the tops of vertical male threaded rods 60, 61, 70, and 71, which are disposed in the corner jambs. Vertical male threaded rods 60, 61, 70, and 71 rotate and their corresponding threaded nuts move downward.

Considering the movement of side wall panel 39, vertical male threaded rod 60 (at one upper edge of side wall panel 39) rotates and first threaded nut 65 moves downward while vertical male threaded rod 61 (at the other upper edge of side wall panel 39*a*) rotates and allows second threaded nut 65' to move downward on rod 61 within rear corner jamb 33. Similarly and simultaneously, vertical male threaded rods 70 and 71 rotate and engage third threaded nut 75 (FIG. 8) and fourth threaded nut 75' (not shown).

As blocks 83 and 83' are attached to the upper part of side wall panel 39*a*, the downward movement of threaded nuts 65 and 65', upon which blocks 83, 83' rest and which support blocks 83, 83', allows side wall panel 39*a* to be folded inward and downward onto side wall panel 39*b* by the articulation of side wall hinges 35 and 31 (FIG. 8) The movement is in the general direction of the arrows 100, with hinge 35 providing a pivot point. The downward folding results in 39*a* and 39*b* coming to a generally horizontal reposed position, as illustrated in FIG. 10.

Simultaneously, or, alternately, sequentially, the opposing side wall panel 49 is lowered in a similar manner by means of hinge pin and block assemblies with threaded nuts 75 and 75', which are threaded down vertical male threaded rods 70 and 71. Side wall panels 49*a* and 49*b* fold inward and downward by the articulation of hinges 45 and 41. Side wall panels 49*a* and 49*b* also come to a generally horizontal reposed position.

End wall assemblies 19 and 29 are then folded inwardly and downwardly at the same time that top section assembly 20 is lowered.

As external power is supplied to the two miter gears 96, 97, the shafts 67*a*, 67*b* carry the power along to miter gears 87, 91. Miter gear 87 meshes with miter gears 101, 102 to rotate horizontal male threaded rods 40*a*, 40*b*. Similarly, miter gear 91 meshes with miter gears 103, 104 to rotate horizontal male threaded rods 30*a*, 30*b*.

Front corner jambs 11 and 13 (connected to the outside edges of end wall panel 89) are hingedly connected to threaded nuts 58 and 68 (FIG. 10). Threaded nuts 58 and 68 are threaded on horizontal male threaded rods 30*a* and 40*a*.

Similarly, the rear corner jambs (connected to the outside edges of end wall panel 99) are hingedly connected to threaded nuts 48 and 38 (FIG. 10). Threaded nuts 48 and 38 are threaded on horizontal male threaded rods 30*b* and 40*b*.

As threaded nuts 58 and 68 move along horizontal male threaded rods 30*a*, 40*a* and threaded nuts 48 and 38 move along horizontal male threaded rods 30*b* and 40*b*, the top section assembly 20 is lowered from its expanded position, designated A (FIG. 10), through a lower position, designated B, until the front corner jambs 11 and 13 in conjunction with the connected end wall panel 89 are substantially horizontal above the previously collapsed side wall panels 39 and 49, designated position C.

First front-bottom hinge 79*a* and second front-bottom hinge 69*a* (FIG. 12) are configured to allow the Front end wall assembly 19 to articulate with bottom section assembly 16 and to lift the bottom edge of end wall assembly 19 upward over the horizontally folded side wall panels 39 and 49 so it can fold inwardly. Similarly, first rear-bottom hinge 79*b* (FIG. 5) and second rear-bottom hinge are configured to allow the Rear end wall assembly 29 to articulate with bottom section assembly 16 and to lift the bottom edge of Rear end wall assembly 29 upward over the horizontal folded side wall panels 39 and 49 so it can fold inwardly.

The following are occurring simultaneously: end wall assembly 19 (end wall panel 89 in conjunction with front corner jambs 11, 13) is being folded inwardly longitudinally; end wall assembly 29 (end wall panel 99 in conjunction with the first rear corner jamb 33 and the second rear corner jamb) is being folded inwardly in a similar manner; and top section assembly 20 is being lowered.

To convert the collapsed container back to the erected state of the collapsible shipping container 10 with the sections joined to form a rigid container, the steps are reversed.

Specifically, as the end wall assemblies 19 and 29 are being pulled upward and outward via threaded nuts 58 and 68 moving along horizontal male threaded rods 30*a*, 40*a* and threaded nuts 48 and 38 moving along horizontal male threaded rods 30*b* and 40*b*, top section assembly 20 is being raised. As this is occurring, first block 83, second block 83', third block (not shown) and fourth block (not shown) slide into their proper position above first threaded nut 65, second threaded nut 65', third threaded nut 75 (FIG. 8) and fourth threaded nut (not shown). Then to raise the side wall panel 39, as vertical male threaded rods 60 and 61 are rotated, threaded nut 65 moves upward with its curved surface 47 under, and frictionally engaged with, rounded surface 37 of block 83 while threaded nut 65' pushes block 83' upward. Thus blocks 83 and 83' are pushed up within front corner jamb 13 and corner jamb 33. And, as blocks 83 and 83' are pushed upward, the upper part of the side wall panel 39*b* is raised, with side wall panels 39*a* and 39*b* unfolding to come to the erect state. Side wall panel 49 is similarly raised.

When the collapsible shipping container 10 is in the collapsed state, it occupies only approximately 17-20 percent of the space required by the current steel containers, thereby allowing 5 or 6 of the collapsible shipping containers to be stacked in the same space now required by one steel container. This not only saves valuable space when storing containers, but also reduces fuel costs when moving containers.

The collapsible shipping container 10 preferably includes at least one security device 15. Security device 15 can be located at any position within the walls or door jambs, so long as the position does not interfere with the articulation of the walls and panels. For example, as seen in FIG. 5, front corner jamb 13 additionally has a security compartment 17 in which at least one security device 15 is located. Security device 15 may be installed in the security compartment 17 at the time of manufacture with security compartment 17 sealed to prevent tampering with the security device 15. Alternatively, security compartment 17 may have a door, preferably opening into the interior of the collapsible shipping container 10, to allow access to security device 15, for maintenance or to allow changes in device type. Although illustrated in front corner jamb 13, security device 15 may be place in any suitable location within the frame.

Security device 15 can be any of a number of anti-theft, supply chain management, or tracking security devices as are known in the art. Also provided is any power supply, internal or external antenna, transmitter, receiver, or data interface, as is required for the security device selected.

For example, security device 15 can be a transmitter that transmits a unique code identifying each individual collapsible shipping container 10. This would allow shippers and shipping companies to identify a collapsible shipping container 10 without visual inspection, which is difficult when multiple containers are stacked in multiple rows.

Alternatively, the security device 15 could be a GPS unit to collect information on the exact latitude and longitude of the collapsible shipping container 10 at various times. This data could be downloaded to a computer when the collapsible shipping container 10 returns.

Alternatively, the security device 15 could be an A-GPS unit, which not only records longitudes, latitudes, and time for later download, but also allows real time tracking. The data is transmitted back to a base unit at designated intervals, or when the base unit queries the A-GPS unit. The security devices 15 could be installed so that an external power supply can connect to them and provide imaging/screening capability so that the security screening of containers takes place at sea, prior to arrival at seaport.

Alternatively, the security device 15 can utilize the cellular towers and technology via, for example, a CDMA-type transmitter, to enable the security device 15 to for more accurate locations and for more extensive data transmittal. Or, similarly, the security device 15 could use satellite communication to receive and transmit data.

Alternatively, the security device 15 can include an external outlet plug attached to wiring embedded within the framework of the shipping container 10. For example, electrical wiring can be incorporated at the time of manufacture into top section assembly 20 and into bottom section assembly 16, or into the 4 corner jambs. This wiring would provide convenience for scanning the shipping container or might be utilized for other security devices. For example, infrared scanners, x-ray scanners, radiation detectors, audio or visual detectors, or other electronic devices could be used.

Figure 14:
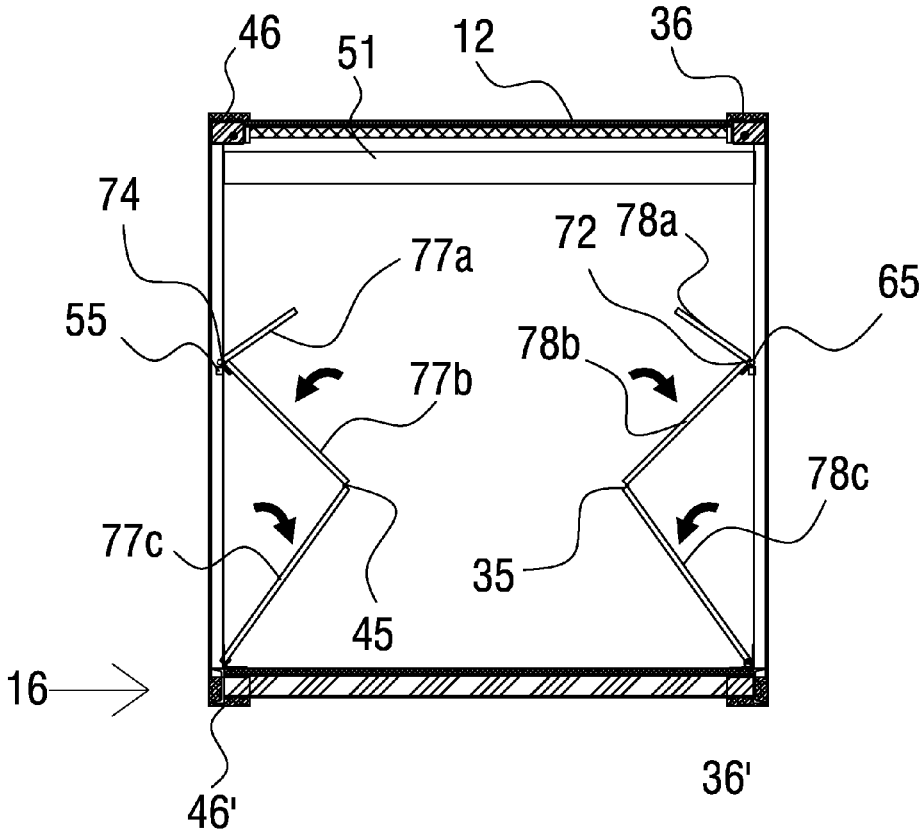
FIG. 14 is a cut-away end view along the lines 2-2 of FIG. 1 illustrating the collapsing operation of the side panels of a second embodiment of the collapsible shipping container of the present invention.

FIG. 14 shows a second embodiment of the present invention, especially designed for a taller container, often called high-cube containers. All aspects of the first embodiment are included in the second embodiment, with a variation in the side wall panel design and the addition of a reinforcing slide arm 51.

In this embodiment, as opposed to the medially horizontally hinged opposing side wall panels 39, of the first embodiment, the horizontally hinged opposing side wall panels 77, 78 are hinged with a second set of horizontal hinges 72, 74. And, as opposed to the side wall panels 39, 49 of the first embodiment, the side wall panels 77, 78 are divided into three sections. The second set of horizontal hinges 72, 74 are disposed at the location of the interconnection of side wall panels 77, 78 with vertical male threaded rod 60, 70. Also, the first set of horizontal hinges 35 and 45 are disposed somewhat lower on side wall panels 77, 78 than on the first embodiment. Therefore, the side wall panels are divided into 3 sections, 77*a*, 77*b*, 77*c* and 78*a*, 78*b*, 78*c*.

The division into three sections, as opposed to the two sections of the first embodiment, enables side wall panels 77, 78, when collapsing, to fold inwardly and downwardly in three pieces. Thereby, the collapsed width of the folded side of walls 77, 78 is reduced, permitting a collapsible shipping container 10 with an increased height to be efficiently collapsed.

Front corner jambs 11, 13 are provided with a reinforcing slide arm 51 that, when the collapsible shipping container 10 is expanded, extends between front corner jamb 11 to front corner jamb 13 inside the container. Reinforcing slide arm 51 can be manually rotated to lock the walls in the upright position, or an additional male threaded rod, associated threaded nut, and hinge can be provided in front corner jamb 11. Electro-mechanical actuators with a standard power supply can be provided to move reinforcing slide arm 51 into position. In a similar manner, rear corner jambs may be provided with a second reinforcing slide arm. Additionally, one or more reinforcing slide arms may be utilized with the first or third embodiment.

Figure 15:
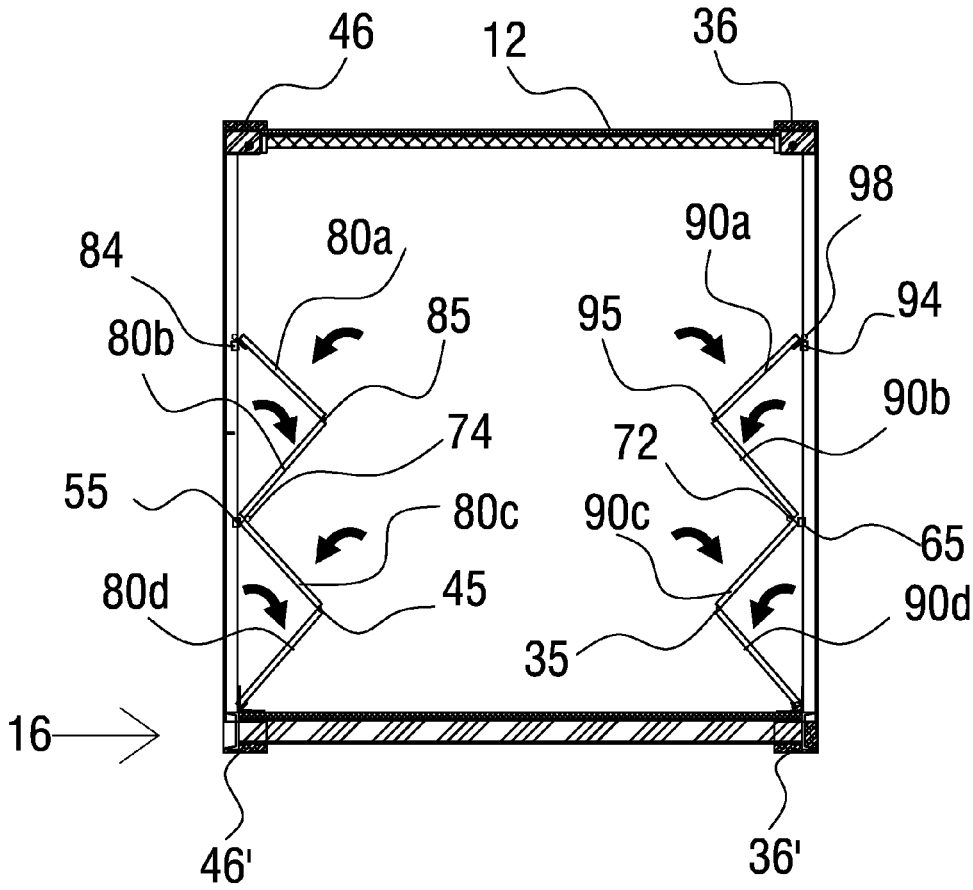
FIG. 15 is a cut-away end view along the lines 2-2 of FIG. 1 illustrating the collapsing operation of the side panels of a third embodiment of the collapsible shipping container of the present invention.

FIG. 15 shows a third embodiment of the present invention, also designed for a taller high-cube container. All aspects of the first embodiment are included in the third embodiment, with a variation in the side wall panel design. The side wall panels 80, 90 are divided into 4 somewhat equal sections, 80*a*, 80*b*, 80*c*, 80*d* and 90*a*, 90*b*, 90*c*, 90*d*.

In this embodiment, as opposed to the medially hinged opposing side wall panels 39, 49 of the first embodiment, horizontally hinged opposing side wall panels 80, 90 are hinged with three additional sets of horizontal hinges 72, 74 and 84, 94 and 85, 95. Also provided are additional vertical male threaded rods in the corner jambs with threaded nuts and hinges installed to allow the upper edge of each side wall panel 80, 90 to collapse.

The first set of additional horizontal hinges 72, 74 are disposed at the location of the lower interconnection of side wall panels 77, 78 with vertical male threaded rod 60 and 70 via vertically-traveling threaded nuts 55, 65. The first set of horizontal hinges 35, 45 are disposed somewhat lower on side wall panels 77, 78 as compared to their placement on the first embodiment.

The second set of additional horizontal hinges 85, 95 are disposed somewhat higher than horizontal hinges 72, 74 on side wall panels 80, 90.

The third set of additional horizontal hinges 84,94 are disposed at the location of the second threaded nuts 88, 98, to provide a second articulation point between the side wall panels 80, 90 and the new male threaded rods.

The division into four sections, as opposed to the two sections of the first embodiment, enables side wall panels 80, 90, when collapsing, to fold inwardly and downwardly in four pieces. Thereby, the collapsed width of the folded side of walls 80, 90 is reduced, and permits a collapsible shipping container 10 with an increased height to be efficiently collapsed.

Figure 20:
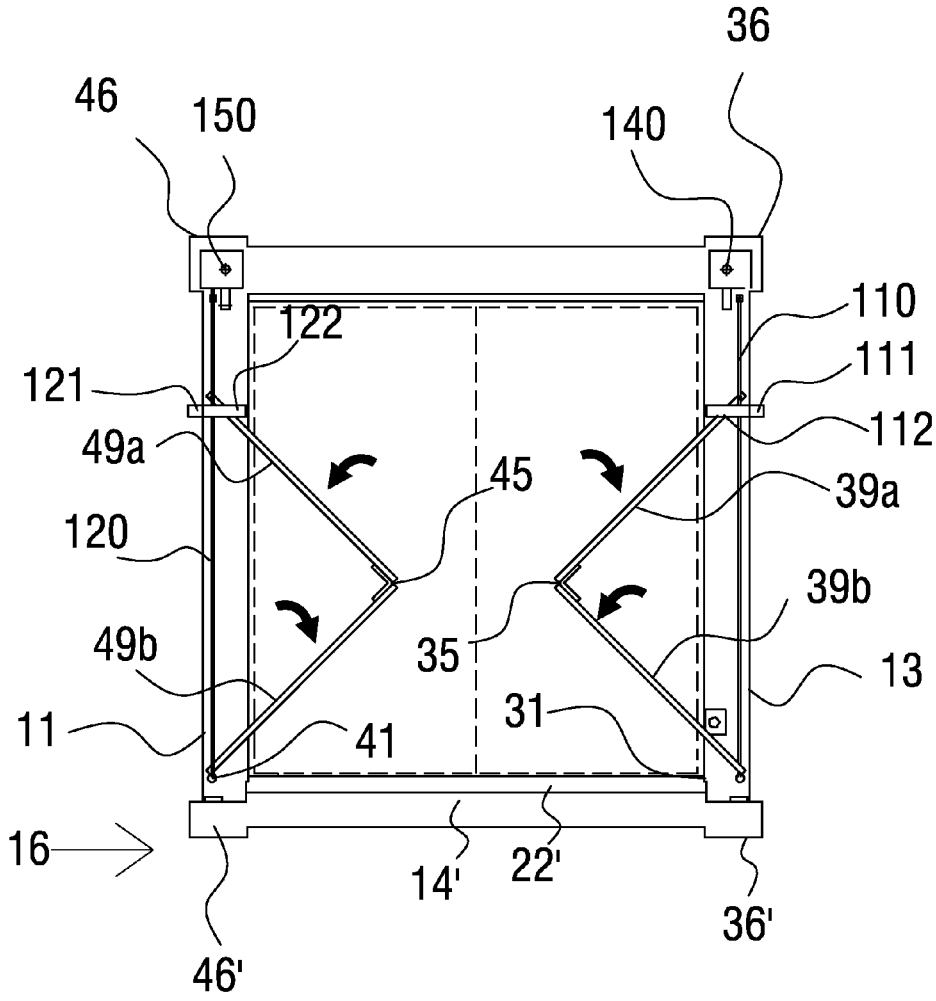
FIG. 20 is a cut-away end view along the lines 2-2 of FIG. 1 illustrating the collapsing operation of the side panels of a fourth embodiment of the collapsible shipping container of the present invention.
Figure 21:
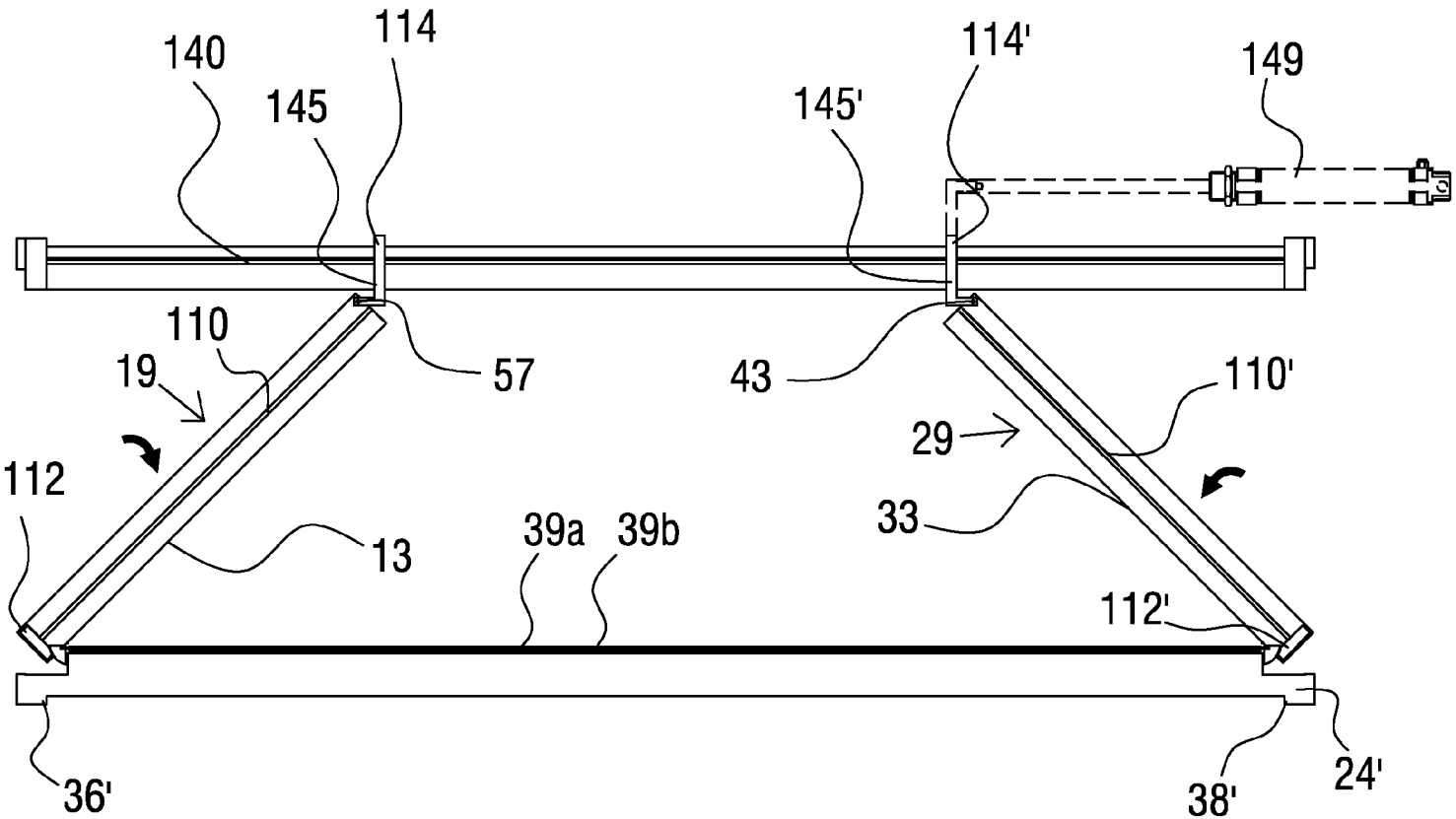
FIG. 21 is a cut-away side view along the lines 5-5 of FIG. 1 illustrating the collapsing operation of the end wall assemblies of the fourth embodiment of the collapsible shipping container of the present invention.

FIG. 20 and FIG. 21 show a fourth embodiment of the present invention. The fourth embodiment is similar to the first embodiment in the movement of the two hinged opposing side wall panels 39 and 49 and two opposing end wall assemblies 19 and 29 during collapsing and expanding, but varies in the mechanisms provided to achieve this collapsing and expanding movement. As in the other embodiments, first the two hinged opposing side wall panels 39 and 49 are folded in upon themselves and then the end wall assemblies 19 and 29 are simultaneously moved longitudinally and linearly inward as the top section assembly 20 is lowered toward the bottom section assembly 16.

However, whereas in the first embodiment, four female-threaded vertically-traveling nuts, 65, 65', 75, 75' moved on the vertical axis of the two front vertical male threaded rods 60, 70 and on the two rear vertical male threaded rods 61, 71 to collapse side wall panels 39*a*, 39*b*, 49*a*, and 49*b*, in the fourth embodiment, two front vertical smooth rods 110, 120 and two rear vertical smooth rods 110'(FIG. 21), 120'(not shown) are provided. Two front perforated vertical slides 112, 122 are slidingly engaged on, and move on the vertical axis of, front vertical smooth rods 110, 120, and two rear perforated vertical slides are slidingly engaged on, and move on the vertical axis of, rear vertical smooth rods 110', 120'. The perforated vertical slides 112, 112', 122, 122' are preferably configured with a concave receiving edge 47 to receive the complementarily shaped convex rounded surface 37 blocks of the block and pin assemblies of the side wall panels, similar to the concave receiving edge 47 of the vertically-traveling nuts, 65, 65', 75, 75' in the first embodiment. Vertical slides 112, 112', 122, 122' are also configured with a perforation that is sized to fit the vertical smooth rods 110, 120, 110', and 120'.

Similarly, the end wall assemblies 19, 29, instead of being retracted and extended by horizontally-traveling female threaded nuts 56, 58, 68, 73 as they move along the horizontal male threaded rods 30*a*, 30*b*, 40*a* as in the first embodiment, are hingedly attached to horizontal slides 140, and 150 as illustrated. Horizontal slides 145, 145', 146, 146' (left side horizontal slides 146, 146' are not shown) are configured to slide on the horizontal axis of horizontal rods 140 (FIG. 20, 21) and 150 (FIG. 20), providing an inward longitudinal movement of end wall assemblies 19, 29.

To collapse the fourth embodiment of the collapsible shipping container 10 external power 149 is applied to initiate the folding motion of side wall panels 39*a*, 39*b*, 49*a*, and 49*b*. While this external power 149 may be supplied in a variety of forms, in the fourth embodiment hydraulic power is used. The supplied external power controls the downward movement during collapsing, and the upward movement while expanding, of side wall panels 39*a*, 39*b*, 49*a*, and 49*b*. While a variety of methods of controlling this movement may be utilized, illustrated is the application of the external power 149 via a tab 111, 121 extending from vertical slides 112, 122 through a slot in the door jambs 11, 33.

After side wall panels 39*a*, 39*b*, 49*a*, and 49*b* fold inward upon themselves, the external power 149 is applied to move the tops of end wall assemblies 19, 29 inward longitudinally by sliding horizontal slides 145, 145', 146, 146' inwardly on horizontal rods 140 and 150. A horizontal slide tab 114, 114', 113, 113' (left side horizontal slides tabs 113, 113' are not shown), extending from the horizontal slides 145, 145', 146, 146' through a channel in the top section assembly and engaging the external power supply 149 is illustrated, but a variety of methods, as is known in the art, can be used. To erect the collapsed shipping container, the steps are reversed.

With any of the above four embodiments, collapsible shipping container 10 is preferably configured to include the securing and lashing fittings of a standard ISO shipping container, including fittings for twist locks, turnbuckles and rods, stacking cones, lashing bars or chains, and bridge pieces in conjunction with lashing bars or chains. The exterior corners of bottom section assembly 16 preferably include fittings for stacking cones to join containers vertically when securing and lashing containers on ship's decks.

Additional modifications to the collapsible shipping container 10 can be made to comply with specific needs. For example any of the following could be provided: a second set of doors on end wall panel 29 to allow rear access, ventilation gratings, bars replacing a solid side wall panel to allow for livestock transport, clothes rails, grappler pockets, gooseneck tunnels, or forklift pockets.

Although the collapsing operation is illustrated with vertical and horizontal male threaded rods, other types of linear actuators that meet the requirements of guidance, load, and speed, are within the scope of the invention. Additionally, the collapsing operation can be powered by a mechanical actuator or a electro-mechanical actuator with a standard power supply. As an example, cables with a pulley and hoist rod can be incorporated into the corner jambs. Such a device could be operated by using either externally supplied power or by supplying a power pack supplied as an integral part of the collapsible shipping container of the present invention.

Thus a shipping container is provided that can be folded into a fraction of the space of a conventional shipping container. The collapsible shipping container of the present invention, when expanded, is water-resistant and vermin-resistant, and meets or exceeds the current standards. It is also environmentally friendly, as five to six empty containers can be transported in the same space as one empty standard steel container, thereby saving fuel costs and vehicle emissions. Additionally, provision is made for increased security through the integration of a security device in the container walls. Furthermore, provision is made for the utilization of a composite material to reduce the weight of the container.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A collapsible shipping container for the transport of cargo that utilizes an external power supply to collapse and expand:

a bottom section assembly comprising a floor panel configured to form a horizontal floor for said collapsible shipping container;

a top section assembly comprising an outer roof framework and a flat roof panel supported within said outer framework, said outer roof framework comprising two forward corner fittings, two rear corner fittings, two upper longitudinal edge beams, and two upper latitudinal edge beams;

a front end wall assembly hingedly attached at a lower edge to said bottom section assembly and attached to said top section assembly in a manner that provides longitudinal linear motion and hinged movement allowing said front end wall assembly to fold inwardly, said front end wall assembly comprising two front corner jambs, a front end wall panel attached between said two front corner jambs, and at least one door configured to allow access to the interior of said collapsible shipping container;

a rear end wall assembly hingedly attached at a lower edge to said bottom section assembly and attached to said top section assembly in a manner that provides longitudinal linear motion and hinged movement allowing said front end wall assembly to fold inwardly, said rear end wall assembly comprising two rear corner jambs and a rear end wall panel attached between said two rear corner jambs;

a right side wall panel hingedly attached at a lower edge area to said bottom section assembly, said right side wall panel comprising an upper right side wall panel section, a lower right side wall panel section, and a longitudinally extending first right side wall hinge configured to allow said right side wall panel to fold inwardly; and a left side wall panel hingedly attached at a lower edge to said bottom section assembly, said left side wall panel comprising an upper left side wall panel section, a lower left side wall panel section, and a longitudinally extending first left side wall hinge, said first left side wall hinge configured to allow said left side wall panel to fold inwardly at least one right longitudinally extending horizontal smooth rod disposed in said top section assembly and at least one left longitudinally extending horizontal smooth rod disposed in said top section assembly;

a first horizontal slider engaged on said at least one left longitudinally extending horizontal smooth rod;

a second horizontal slider engaged on said at least one left longitudinally extending horizontal smooth rod;

a third horizontal slider engaged on said at least one right longitudinally extending horizontal smooth rod; and a fourth horizontal slider engaged on one of said at least one right longitudinally extending horizontal smooth rod;

a first door jamb-nut hinge that hingedly connects said first horizontal slider to a first one of said two front comer jambs;

a second door jamb-nut hinge that hingedly connects said second horizontal slider to a first one of said two rear comer jambs;

a third door jamb-nut hinge that hingedly connects said third horizontal slider to a second one of said two front corner jambs; and a fourth door jamb-nut hinge that hingedly connects said fourth horizontal slider to a second one of said two rear corner jambs;

two rear vertical male smooth rods disposed within said two rear comer jambs;

two front vertical male smooth rods disposed within said two front comer jambs; and four vertical sliders engaged on one of said two rear vertical male smooth rods or on one of said two front vertical male smooth rods.

2. The collapsible shipping container as recited in claim 1, wherein:

said four vertical sliders are configured with a inward-facing concave rounded surface;

said right side wall panel further comprises a first hinge pin attached to said right side wall panel at an upper edge;

said right side wall panel further comprises a second hinge pin attached to said right side wall panel at the opposing upper edge;

said right side wall panel further comprises a first block connected to said first hinge pin, said first block configured with a rounded convex surface configured to complement said concave rounded surface of said four vertical sliders;

said right side wall panel further comprises a second block connected to said second hinge pin, said second block configured with a rounded convex surface configured to complement said concave rounded surface of said four vertical sliders;

said left side wall panel further comprises a third hinge pin attached to an upper edge of said left side wall panel;

said left side wall panel further comprises a fourth hinge pin attached to the opposing upper edge of said left side wall panel;

said left side wall panel further comprises a third block connected to said third hinge pin, said third block configured with a rounded convex surface configured to complement said concave rounded surface of said four vertical sliders; and said left side wall panel further comprises a fourth block connected to said fourth hinge pin, said fourth block configured with a rounded convex surface configured to complement said concave rounded surface of said four vertical sliders.

3. The collapsible shipping container as recited in claim 2, further comprising a security device.

4. The collapsible shipping container, as recited in claim 1, wherein said top section assembly further comprises:

at least one right longitudinally extending horizontal threaded rod and at least one left longitudinally extending horizontal threaded rods;

a first horizontally-traveling threaded nut engaged on one of said at least one left longitudinally extending horizontal threaded rods;

a second horizontally-traveling threaded nut engaged on one of said at least one left longitudinally extending horizontal threaded rods;

a third horizontally-traveling threaded nut engaged on one of said at least one right longitudinally extending horizontal threaded rods; and a fourth horizontally-traveling threaded nut engaged on one of said at least one right longitudinally extending horizontal threaded rods.

5. The collapsible shipping container, as recited in claim 4, further comprising:

a first door jamb-nut hinge that hingedly connects said first horizontally-traveling threaded nut to a first one of said two front corner jambs;

a second door jamb-nut hinge that hingedly connects said second horizontally-traveling threaded nut to a first one of said two rear corner jambs;

a third door jamb-nut hinge that hingedly connects said third horizontally-traveling threaded nut to a second one of said two front corner jambs; and a fourth door jamb-nut hinge that hingedly connects said fourth horizontally-traveling threaded nut to a second one of said two rear corner jambs.

6. The collapsible shipping container as recited in claim 5, further comprising:

two rear vertical male threaded rods disposed within said two rear corner jambs;

two front vertical male threaded rods disposed within said two front corner jambs; and four vertically-traveling female-threaded nuts engaged on one of said two rear vertical male threaded rods or on one of said two front vertical male threaded rods.

7. The collapsible shipping container as recited in claim 6, wherein:

said four vertically-traveling female-threaded nuts are configured with a inward-facing concave rounded surface;

said right side wall panel further comprises a first hinge pin attached to said right side wall panel at an upper edge;

said right side wall panel further comprises a second hinge pin attached to said right side wall panel at the opposing upper edge;

said right side wall panel further comprises a first block connected to said first hinge pin, said first block configured with a rounded convex surface configured to complement said concave rounded surface of said four vertically-traveling female-threaded nuts;

said right side wall panel further comprises a second block connected to said second hinge pin, said second block configured with a rounded convex surface configured to complement said concave rounded surface of said four vertically-traveling female-threaded nuts;

said left side wall panel further comprises a third hinge pin attached to an upper edge of said left side wall panel;

said left side wall panel further comprises a fourth hinge pin attached to the opposing upper edge of said left side wall panel;

said left side wall panel further comprises a third block connected to said third hinge pin, said third block configured with a rounded convex surface configured to complement said concave rounded surface of said four vertically-traveling female-threaded nuts; and said left side wall panel further comprises a fourth block connected to said fourth hinge pin, said fourth block configured with a rounded convex surface configured to complement said concave rounded surface of said four vertically-traveling female-threaded nuts.

8. The collapsible shipping container, as recited in claim 7, wherein:

said top section assembly further comprises a first upper latitudinal center shaft and a second upper latitudinal center shaft;

said first upper latitudinal center shaft comprises a first miter gear and a second miter gear disposed on opposing ends of said first upper latitudinal center shaft;

said second upper latitudinal center shaft comprises a third miter gear and a fourth miter gear disposed on opposing ends of said first upper latitudinal center shaft, wherein said first miter gear and said third miter gear are configured to simultaneously receive power from said external power supply;

said first one of said at least one left longitudinally extending horizontal threaded rods comprises a fifth miter gear configured to mesh with said second miter gear, wherein said first horizontally-traveling threaded nut is moved along said first one of said at least one left longitudinally extending horizontal threaded rods;

said second one of said at least one left longitudinally extending horizontal threaded rods comprises a sixth miter gear configured to mesh with said second miter gear, wherein said second horizontally-traveling threaded nut is moved along said second one of said at least one left longitudinally extending horizontal threaded rods;

said first one of said at least one right longitudinally extending horizontal threaded rods comprises a seventh miter gear configured to mesh with said fourth miter gear, wherein said third horizontally-traveling threaded nut is moved along said first one of said at least one right longitudinally extending horizontal threaded rods; and said second one of said at least one right longitudinally extending horizontal threaded rods comprises an eighth miter gear configured to mesh with said fourth miter gear, wherein said fourth horizontally-traveling threaded nut is moved along said second one of said at least one right longitudinally extending horizontal threaded rods.

9. The collapsible shipping container as recited in claim 7, further comprising a security device.

10. The collapsible shipping container as recited in claim 9, wherein said security device comprises a tracking device.

11. The collapsible shipping container as recited in claim 9, wherein said security device comprises a GPS unit.

12. The collapsible shipping container as recited in claim 9, wherein said security device comprises a transmitter.

13. The collapsible shipping container as recited in claim 7, wherein:

said bottom section assembly further comprises two lower longitudinal edge beams, two lower forward corner fittings, two lower rear corner fittings, and two lower latitudinal edge beams, which fit together into a rectangular-shaped framework configured to support said floor panel, said two rear corner jambs, and said two front corner jambs; and said two upper longitudinal edge beams, said two upper latitudinal edge beams, said two lower longitudinal edge beams, and said two lower latitudinal edge beams are composed of a high strength composite material.

14. The collapsible shipping container as recited in claim 13, wherein said two front corner jambs, said two rear corner jambs, said front end wall panel, said rear end wall panel, said right side wall panel, and said left side wall panel are composed of a high strength composite material.

15. The collapsible shipping container as recited in claim 7, wherein:

said right side wall panel further comprises a second longitudinally extending right side wall hinge and a middle right side wall panel; and said left side wall panel further comprises a second longitudinally extending left side wall hinge and a middle left side wall panel.

16. A collapsible inter-modal shipping container:

a bottom section assembly comprising a floor panel configured to form a horizontal floor for said shipping container, two lower longitudinal edge beams, two lower forward corner fittings, two lower rear corner fittings, and two lower latitudinal edge beams, wherein said two lower longitudinal edge beams, said two lower forward corner fittings, said two lower rear corner fittings, and said two lower latitudinal edge beams fit together into a rectangular-shaped lower framework;

a top section assembly comprising two forward corner fittings, two rear corner fittings, two upper longitudinal edge beams and two upper latitudinal edge beams fitted together into a rectangular-shaped top framework, said top section further comprising a flat roof panel supported by said top framework and configured to form a horizontal roof for said shipping container, said top section assembly further comprising two right longitudinally extending horizontal threaded rods, two left longitudinally extending horizontal threaded rods, a first horizontally-traveling threaded nut engaged on one of said two left longitudinally extending horizontal threaded rods, a second horizontally-traveling threaded nut engaged on a second one of said two left longitudinally extending horizontal threaded rods; a third horizontally-traveling threaded nut engaged on one of said two right longitudinally extending horizontal threaded rods; and a fourth horizontally-traveling threaded nut engaged on a second one of said two right longitudinally extending horizontal threaded rods;

a front end wall assembly comprising two front-bottom hinges to attach said front end wall assembly to said bottom section assembly, said front end wall assembly further comprising two front corner jambs and a front end wall panel attached between said two front corner jambs, said front end wall panel comprising at least one door configured to allow access to the interior of said shipping container, wherein one of said two front corner jambs is hingedly attached to said first horizontally-traveling threaded nut and wherein the other of said two front corner jambs is hingedly attached to said third horizontally-traveling threaded nut;

a rear end wall assembly comprising two rear-bottom hinges to attach said rear end wall assembly to said bottom section assembly, said rear end wall assembly further comprising two rear corner jambs and a rear end wall panel attached between said two rear corner jambs, wherein one of said two rear corner jambs is hingedly attached to said second horizontally-traveling threaded nut and wherein the other of said two rear corner jambs is hingedly attached to said fourth horizontally-traveling threaded nut;

two rear vertical male threaded rods disposed within said two rear corner jambs;

two front vertical male threaded rods disposed within said two front corner jambs;

four vertically-traveling female-threaded nuts, each of said four vertically-traveling female-threaded nuts configured with a inward-facing concave rounded surface, and each of said four vertically-traveling female-threaded nuts engaged on one of said two rear vertical male threaded rods or on one of said two front vertical male threaded rods;

a right side wall panel hingedly attached at a lower edge area to said bottom section assembly, said right side wall panel comprising a first hinge pin attached to said right side wall panel at an upper edge, a second hinge pin attached to said right side wall panel at the opposing upper edge, a first block connected to said first hinge pin, a second block connected to said second hinge pin, an upper right side wall panel section, a lower right side wall panel section, and a longitudinally extending first right side wall hinge, wherein said upper right side wall panel section is hingedly attached by said first right side wall hinge to said lower right side wall panel section, and wherein said first right side wall hinge is configured to allow said right side wall panel to fold inwardly at pivot point of said first right side wall hinge; and a left side wall panel hingedly attached at a lower edge to said bottom section assembly, said left side wall panel comprising a third hinge pin attached to an upper edge of said left side wall panel, a fourth hinge pin attached to the opposing upper edge of said left side wall panel, a third block connected to said third hinge pin, a fourth block connected to said fourth hinge pin, an upper left side wall panel section, a lower left side wall panel section, and a longitudinally extending first left side wall hinge, said upper left side wall panel section being hingedly attached by said first left side wall hinge to said lower left side wall panel section, wherein said first left side wall hinge is configured to allow said left side wall panel to fold inwardly at the pivot point of said first left side wall hinge, and wherein said first block, said second block, said third block, and said fourth block are each configured with a rounded convex surface configured to complement said concave rounded surface of said four vertically-traveling female-threaded nuts.

17. The collapsible inter-modal shipping container as recited in claim 16, further comprising a security device.

* * * * *